252-97 AU 157 EX
7/31/84 XR 4,462,922

United States Patent [19]

Boskamp

[11] Patent Number: 4,462,922

[45] Date of Patent: Jul. 31, 1984

[54] ENZYMATIC LIQUID DETERGENT COMPOSITION

[75] Inventor: Jelles V. Boskamp, Vlaardingen, Netherlands

[73] Assignee: Lever Brothers Company, New York, N.Y.

[21] Appl. No.: 438,665

[22] Filed: Nov. 2, 1982

[30] Foreign Application Priority Data

Nov. 19, 1981 [GB] United Kingdom ..... 8134887

[51] Int. Cl.[3] ..... C11D 3/386; C11D 7/10; C11D 1/94

[52] U.S. Cl. ..... 252/174.12; 252/97; 252/109; 252/135; 252/139; 252/173; 435/188

[58] Field of Search ..... 252/174.12, 97, 109, 252/DIG. 12, DIG. 14, 135, 139, 173; 435/188

[56] References Cited

U.S. PATENT DOCUMENTS

| | | | |
|---|---|---|---|
| 2,095,300 | 10/1937 | Wallerstein | 435/219 |
| 3,741,901 | 6/1973 | Ziffer | 252/89 |
| 3,940,341 | 2/1976 | Gray et al. | 252/105 |
| 4,243,543 | 1/1981 | Guilbert et al. | 252/DIG. 12 X |
| 4,261,868 | 4/1981 | Hora et al. | 252/174.12 X |
| 4,268,406 | 5/1981 | O'Brien et al. | 252/105 |

FOREIGN PATENT DOCUMENTS

| | | | |
|---|---|---|---|
| 2079305 | 1/1982 | United Kingdom | 252/174.12 |

*Primary Examiner*—John E. Kittle
*Assistant Examiner*—Mukund J. Shah
*Attorney, Agent, or Firm*—Milton L. Honig; James J. Farrell

[57] ABSTRACT

The invention relates to aqueous enzymatic liquid detergent compositions. The use of a known enzyme-stabilizing system therein, which comprises a mixture of boric acid or an alkalimetalborate with a polyol or a polyfunctional amino compound, together with a certain level of a reducing alkalimetal salt such as sodium sulphite produces a synergistic enzyme-stabilizing effect.

6 Claims, No Drawings

ENZYMATIC LIQUID DETERGENT COMPOSITION

The present invention relates to an aqueous liquid enzymatic detergent composition with improved enzyme-stability.

Aqueous liquid enzymatic detergent compositions are well-known in the prior art. A major problem which is encountered with such compositions is that of ensuring a sufficient storage-stability of the enzymes in such compositions. The prior art has already described various ways in which this problem can be overcome, e.g. by inclusion of enzyme-stabilizing systems in such liquid detergent compositions.

Thus, it has been proposed to include a mixture of a polyol and boric acid or an alkalimetalborate in an aqueous liquid enzymatic detergent composition. This system indeed increases the stability of the enzymes in liquid detergent compositions.

It has also been proposed to include a mixture of a polyfunctional amino compound having at least one amine grouping and at least two hydroxyl groups and boric acid or an alkalimetalborate as enzyme-stabilizing system in aqueous liquid detergent compositions. This system also improves the enzyme storage stability in such detergent compositions.

Recently, it has been proposed to use a mixture of a water-dispersible antioxidant and an organic, hydrophilic, water-soluble polyol having a molecular weight of less than about 500 as enzyme-stabilizing system in liquid detergent compositions. Preferably a buffering amount of a weak base, such as an alkanolamine, is also present in the enzymatic liquid detergent composition.

It has now been found that a mixture of a polyol and/or a polyfunctional amino compound, with boric acid or an alkalimetalborate and with an antioxidant produces a synergistic enzyme-stabilizing effect, that is an effect which surmounts the sum-effect of each of the binary systems.

It has been found that in the mixture of the invention the antioxidant must be present above a certain level, as well as the boric acid or the alkalimetalborate.

The antioxidant should be present in the mixture in an amount of at least 5% by weight of the final enzymatic aqueous liquid detergent composition, and the boric acid or alkalimetalborate in an amount of at least 2% by weight of the final enzymatic aqueous liquid detergent composition.

The polyol should be present in an amount at least equal to the amount of boric acid or alkalimetalborate, and the polyfunctional amino compound should be present in such an amount, that the weight ratio of this compound to the boric acid or alkalimetalborate is at least 0.5.

The essential constituents of the mixture of the invention will now be further discussed in detail.

The polyols that can be used in the present invention are polyols containing from 2 to 6 hydroxyl groups. They contain only C, H, and O atoms. Typical examples are ethyleneglycol, propyleneglycol, 1,2 propanediol, butyleneglycol, hexyleneglycol, glycerol, mannitol, sorbitol erythritol, glucose, fructose, lactose and erythritan (=1,4-anhydride of erythritol). Preferably glycerol is used.

In general, the amount of polyol used ranges from 2 to 25%, preferably from 5 to 15% by weight of the final composition.

The polyfunctional amino compounds that can be used in the present invention contain at least one amine grouping and at least two hydroxylgroups. Suitable examples are diethanolamine, triethanolamine, di-isopropanolamine, tri-isopropanolamine, and tris(hydroxymethyl) aminomethane. It is to be understood that quaternary ammonium compounds are not included in the term polyfunctional amino compound. Preferably triethanolamine is used.

In general, the amount of polyfunctional amino compound used ranges from 2 to 25, preferably from 4–15% by weight of the final composition.

Mixtures of various polyols or various polyfunctional amino compounds may also be used, as well as mixtures of polyols and polyfunctional compounds.

The boron compound that is used in the present invention is a boron compound which is capable of reacting with the polyol or polyfunctional amino compound. Suitable examples thereof are boric acid, boric oxide and alkalimetalborates such as sodium and potassium ortho-, meta-, and pyroborate, borax, and polyborates. Preferably the boron compound is borax.

In general, the amount of boron compound used ranges from 2 to 15, preferably from 3.5–10% by weight of the final composition.

The amount of polyol used should be at least equal to the amount of boron compound used in the final composition; generally the weight ratio of the amount of polyol to the amount of the boron compound ranges from 1 up to two, and preferably from 1 to 1.6.

The amount of polyfunctional amino compound used should be at least half the amount of the boron compound used; generally the weight ratio of the amount of the polyfunctional amino compound to the amount of boron compound ranges from 1:2 to 10:1, preferably from 7:1 to 2:1.

The boron compound is to be calculated on the basis of borax for all the above ranges.

Mixtures of various boron compounds can also be used.

The antioxidants that are used in the present invention are reducing alkalimetalsalts having an oxygenated sulphur anion $S_aO_b$ in which a and b are numbers from 1 to 8. Typical examples of such reducing salts are alkalimetalsulphites, alkalimetalbisulphites, alkalimetabisulphites, alkalimetalthiosulphates, in which the alkalimetal is sodium or potassium. Of these, sodium sulphite is the preferred compound.

The reducing alkalimetal salt is used in an amount ranging from 5–20, preferably from 6–15% by weight of the final compositions.

The aqueous liquid compositions in which the stabilizing systems of the invention are incorporated are aqueous, liquid enzymatic detergent compositions further comprising as essential ingredients enzymes, and active detergents.

The enzymes to be incorporated can be proteolytic, amylolytic and cellulolytic enzymes as well as mixtures thereof. They may be of any suitable origin, such as vegetable, animal, bacterial, fungal and yeast origin. However, their choice is governed by several factors such as pH activity and/or stability optima, thermostability, stability versus active detergents, builders and so on. In this respect bacterial or fungal enzymes are preferred, such as bacterial amylases and proteases, and fungal cellulases. Although the liquid compositions of the present invention may have a near-neutral pH value, the present invention is of particular benefit for enzymatic liquid detergents with a pH of 7.5 or above, especially those incorporating bacterial proteases of which the pH-optima lie in the range between 8.0 and 11.0, but it is to be understood that enzymes with a somewhat lower or higher pH-optimum can still be used in the compositions of the invention, benefiting from it.

Suitable examples of proteases are the subtilisins which are obtained from particular strains of *B. subtilis* and *B. licheniformis*, such as the commercially available subtilisins Maxatase TM (ex Gist-Brocades N.V., Delft, Holland) and Alcalase TM (ex Novo Industri A/S, Copenhagen, Denmark).

As stated above, the present invention is of particular benefit for enzymatic liquid detergents incorporating enzymes with pH-activity and/or stability optima of above 8.0, such enzymes being commonly called high-alkaline enzymes.

Particularly suitable is a protease obtained from a strain of Bacillus, having maximum activity throughout the pH-range of 8-12, developed and sold by Novo Industri A/S under the registered trade name of Esperase TM.

The preparation of this enzyme and analogous enzymes is described in British Patent Specification No. 1,243,784 of Novo.

High-alkaline amylases and cellulase can also be used, e.g. alpha-amylases obtained from a special strain of *B. licheniformis*, described in more detail in British Patent Specification No. 1,296,839 (Novo).

The enzymes can be incorporated in any suitable form, e.g. as a granulate (marumes, prills etc.), or as a liquid concentrate. The granulate form has often advantages.

The amount of enzymes present in the liquid composition may vary from 0.001 to 10% by weight, and preferably from 0.01 to 5% by weight.

The liquid detergent compositions of the invention furthermore comprise as essential ingredient an active detergent material, which may be an alkali metal or alkanol amine soap or a $C_{10}$-$C_{24}$ fatty acid, including polymerized fatty acids, or an anionic, nonionic, cationic, zwitterionic or amphoteric synthetic detergent material, or mixtures of any of these.

Examples of anionic synthetic detergents are salts (including sodium, potassium, ammonium, and substituted ammonium salts such as mono-, die- and triethanolamine salts) of $C_9$-$C_{20}$ alkylbenzenesulphonates, $C_8$-$C_{22}$ primary or secondary alkanesulphonates, $C_8$-$C_{24}$ olefinsulphonates, sulphonated polycarboxylic acids, prepared by sulphonation of the pyrolyzed product of alkaline earth metal citrates, e.g. as described in British Patent Specification No. 1,082,179, $C_8$-$C_{22}$ alkylsulphates, $C_8$-$C_{24}$ alkylpolyglycolethersulphates (containing up to 10 moles of ethylene oxide); further examples are described in "Surface Active Agents and Detergents" (Vol. I and II) by Schwartz, Perry and Berch.

Examples of nonionic synthetic detergents are the condensation products of ethylene oxide, propylene oxide and/or butyleneoxide with $C_8$-$C_{18}$ alkylphenols, $C_8$-$C_{18}$ primary or secondary aliphatic alcohols, $C_8$-$C_{18}$ fatty acid amides; further examples of nonionics include tertiary amine oxides with one $C_8$-$C_{18}$ alkyl chain and two $C_{1-3}$ alkyl chains. The above reference also describes further examples of nonionics.

The average number of moles of ethylene oxide and/or propylene oxide present in the above nonionics varies from 1-30; mixtures of various nonionics, including mixtures of nonionics with a lower and a higher degree of alkoxylation, may also be used.

Examples of cationic detergents are the quaternary ammonium compounds such as alkyldimethylammonium halogenides, but such cationics are less preferred for inclusion in enzymatic detergent compositions.

Examples of amphoteric or zwitterionic detergents are N-alkylamino acids, sulphobetaines, condensation products of fatty acids with protein hydrolysates, but owing to their relatively high costs they are usually used in combination with an anionic or a nonionic detergent. Mixtures of the various types of active detergents may also be used, and preference is given to mixtures of an anionic and a nonionic detergent active. Soaps (in the form of their sodium, potassium, and substituted ammonium salts) of fatty acids may also be used, preferably in conjunction with an anionic and/or a nonionic synthetic detergent.

The amount of the active detergent material varies from 1 to 60%, preferably from 2-40 and especially preferably from 5-25%; when mixtures of e.g. anionics and nonionics are used, the relative weight ratio varies from 10:1 to 1:10, preferably from 6:1 to 1:6. When a soap is also incorporated, the amount thereof is from 1-40% by weight.

The liquid compositions of the invention may further contain up to 60% of a suitable builder, such as sodium, potassium and ammonium or substituted ammonium pyro- and tripolyphosphates, -ethylenediamine tetraacetates, -nitrilotriacetates, -etherpolycarboxylates, -citrates, -carbonates, -orthophosphates, zeolites, carboxymethyloxysuccinate, etc. Particularly preferred are the polyphosphate builder salts, nitrilotriacetates, citrates, zeolites, and mixtures thereof. In general the builders are present in an amount of 1-60, preferably 5-50% by weight of the final composition.

The amount of water present in the detergent compositions of the invention varies from 5 to 70% by weight.

Other conventional materials may also be present in the liquid detergent compositions of the invention, for example soil-suspending agents, hydrotropes, corrosion inhibitors, dyes, perfumes, silicates, optical brighteners, suds depressants such as silicones, germicides, anti-tarnishing agents, opacifiers, fabric softening agents, oxygen-liberating bleaches such as hydrogen peroxide, sodium perborate or percarbonate, disperisophthalic anhydride, with or without bleach precursors, buffers and the like. When the composition contains a builder, it may sometimes be advantageous to include a suspension stabilizer in the composition to provide a satisfactory phase-stability. Such stabilizers include natural or synthetic polymers, which however should not be capable of reacting with the boron compound. Suitable examples of such suspension stabilizers are polyacrylates, copolymers of maleic anhydride and ethylene or vinylmethylether, and polymers of acrylic acid, cross-linked with not more than 10% of a vinyl-group containing cross-linking agent, e.g. polymers of acrylic acid, cross-linked with about 1% of a polyallyl ether of sucrose having an average of about 5.8 alkylgroups for each sucrose molecule. Examples of the latter are commercially available products, available under the registered trade name of Carbopol 934, 940 and 941 of B. F. Goodrich Co. Ltd.

In general, if a suspension stabilizer is required, it will be included in an amount of 0.1-2, usually 0.25-1% by weight of the final composition.

The invention will now be further illustrated by way of Example. In the examples, all the percentages are percentages by weight of the final composition.

The pH of the final composition is near neutral, preferably higher than 7.5, and should preferably lie within the range of 8.0 to 10.0, and is, if necessary, buffered to a value within that range by addition of a suitable buffer system. The pH of the wash liquor, when using the composition, is about 1 pH unit higher than the above values at an in-use concentration of about 1%.

EXAMPLE 1

The following compositions with varying amounts of polyol, boron compound and reducing agent were prepared:

| | % |
|---|---|
| Sodium dodecylbenzenesulphonate | 5 |
| $C_{13}$–$C_{15}$ linear primary alcohol, condensed with 7 moles of alkylene oxide, which is a mixture of ethylene- and propylene-oxide in a weight ratio of 92:8 | 2 |
| pentasodium tripolyphosphate (anh.) | 27.2 |
| glycerol | x |
| borax | y |
| sodium sulphite | z |
| sodium carboxymethylcellulose | 0.2 |
| fluorescer | 0.1 |
| bacterial protease (Alcalase ®) | 0.7 |
| water | balance. |

The half-life time of the enzyme was measured at 37° C. in each of the compositions, and the following results were obtained:

| | A | | | | B | | | |
|---|---|---|---|---|---|---|---|---|
| x (in %) | 3 | 3 | — | 3 | 5 | 5 | — | 5 |
| y (in %) | 2 | — | 2 | 2 | 3.5 | — | 3.5 | 3.5 |
| z (in %) | — | 6 | 6 | 6 | — | 6 | 6 | 6 |
| half-life time (in weeks) | 0.5 | 1.2 | 1.0 | 4.2 | 2.5 | 1.0 | 1.2 | 16 |

| | C | | | | D | | | E | | |
|---|---|---|---|---|---|---|---|---|---|---|
| x (in %) | 7.5 | 7.5 | — | 7.5 | 7.5 | 7.5 | 7.5 | 7.5 | 7.5 | 7.5 |
| y (in %) | 7.0 | — | 7.0 | 7.0 | 7.0 | — | 7.0 | 7.0 | — | 7.0 |
| z (in %) | — | 7.5 | 7.5 | 7.5 | — | 5.0 | 5.0 | — | 2.5 | 2.5 |
| half-life time (in weeks) | 6.5 | 6.0 | 5.5 | 23 | 6.5 | 0.5 | 10 | 6.5 | 0.5 | 5.5 |

As can be seen from series A–D, the mixtures of the invention produce an effect which clearly surmounts the sum effects of the individual binary mixtures.

In series E, where there is less than the required 5% of the sulphite present, there is no such effect.

EXAMPLE 2

The following formulations were prepared

| | % |
|---|---|
| $C_{13}$–$C_{15}$ linear primary alcohol, condensed with 7 moles of alkyleneoxide, which is a mixture of ethylene- and propyleneoxide in a ratio of 92:8 | 6.5 |
| pentasodium tripolyphosphate (anh.) | 20.0 |
| sodiumcarboxymethylcellulose | 0.45 |
| fluorescer | 0.15 |
| perfume | 0.15 |
| silicone oil | 0.30 |
| Carbopol ® 941 | 0.64 |
| bacterial protease (Alcalase ®) | 0.7 |
| glycerol | x |
| borax | y |
| sodium sulphite | z |
| water | balance |

The half-life times of the enzyme in this composition at 37° C. were as follows:

| | | | |
|---|---|---|---|
| x (in %) | — | 10 | 10 |
| y (in %) | — | 5 | 5 |
| z (in %) | 5 | — | 5 |
| half-life time (in weeks) | 0.4 | 10 | 40 |

Again this shows an unexpected increase in half-life time.

I claim:

1. An aqueous enzymatic liquid detergent composition comprising:
   (a) from 1 to 60% by weight of an anionic, nonionic, cationic, zwitterionic active detergent material or mixtures thereof,
   (b) from 0.001 to 10% by weight of proteolytic, amylolytic, cellulolytic enzymes or mixtures thereof,
   (c) from 2 to 15% by weight of boric acid or an alkalimetal borate,
   (d) from 2 to 25% by weight of a polyhydroxy compound selected from the group consisting of ethyleneglycol, propylene glycol, 1,2-propanediol, butyleneglycol, hexyleneglycol, glycerol, mannitol, sorbitol, erythritol, glucose fructose, lactose, erythritol-1,4-anhydride, and mixtures thereof, the weight ratio of (d):(c) being from 1:1 to 2:1,
   (e) from 5 to 20% by weight of a reducing alkalimetal salt selected from the group consisting of alkalimetal-sulphites, -bisulphites, -metabisulphites, -thiosulphates and mixtures thereof, and
   (f) from 5 to 70% by weight of water.

2. The composition of claim 1, wherein the reducing alkalimetal salt is sodiumsulphite.

3. The composition of claim 1, wherein the polyhydroxy compound is glycerol.

4. The composition of claim 1, wherein the alkalimetalborate is borax.

5. The composition of claim 1, further comprising 1–60% by weight of a detergency builder.

6. The composition according to claim 1, further comprising from 2 to 25% of a polyfunctional amino compound selected from the group consisting of diethanolamine, triethanolamine, di-isopropanolamine, triisopropanolamine, tris(hydroxymethyl)aminomethane, and mixtures thereof, the weight ratio of amino compound to boric acid or alkalimetal borate being from 1:2 to 10:1.

* * * * *